US006024161A

United States Patent [19]

Fujioka et al.

[11] Patent Number: 6,024,161

[45] Date of Patent: Feb. 15, 2000

[54] BILLET CONTINUOUS CASTING MACHINE

[75] Inventors: Hironori Fujioka; Hiroshi Nakajima; Masahiro Kassai, all of Hiroshima, Japan

[73] Assignee: Mitsubishi Heavy Industries, Ltd., Tokyo, Japan

[21] Appl. No.: 09/006,439

[22] Filed: Jan. 13, 1998

[30] Foreign Application Priority Data

Apr. 8, 1997 [JP] Japan ..... 9-089401

[51] Int. Cl.[7] ..... B22D 11/04; B22D 11/20

[52] U.S. Cl. ..... 164/413; 164/444; 164/454; 164/466; 164/486; 164/502

[58] Field of Search ..... 164/413, 444, 164/502, 454, 486, 466

[56] References Cited

U.S. PATENT DOCUMENTS

| | | | |
|---|---|---|---|
| 3,882,924 | 5/1975 | Fujikawa | 164/444 X |
| 4,136,728 | 1/1979 | Schmid | 164/444 |
| 5,004,040 | 4/1991 | Pleschiutsch et al. | 164/413 |
| 5,564,487 | 10/1996 | Cahill et al. | 164/413 X |
| 5,871,040 | 2/1999 | Kaseda et al. | 164/486 X |

FOREIGN PATENT DOCUMENTS

| | | | |
|---|---|---|---|
| 1483925 | 5/1967 | France | 164/444 |
| 53-930 | 1/1978 | Japan . | |
| 53-42287 | 11/1978 | Japan . | |
| 57-106553 | 7/1982 | Japan . | |
| 63-137547 | 6/1988 | Japan . | |
| 63-242444 | 10/1988 | Japan . | |
| 4-319044 | 11/1992 | Japan . | |
| 5-293597 | 11/1993 | Japan . | |
| 6-297101 | 10/1994 | Japan . | |
| 6-297106 | 10/1994 | Japan . | |

*Primary Examiner*—J. Reed Batten, Jr.

[57] ABSTRACT

A billet continuous casting machine comprises, a jacket for cooling an outer wall of a quadrangular tubular mold with cooling water, electromagnetic brakes disposed outside the mold and decelerating the flow of poured molten metal in the mold, an X ray-based level sensor for detecting the level of molten metal in the mold, notched portions formed at the corners of a quadrangular lower part of the mold, spray nozzles for spraying a cooling liquid directly onto the notched portions, and elastically pushing unit for imparting a pushing force corresponding to the static pressure of the molten metal to unnotched portions of the quadrangular lower part of the mold to push the unnotched portions inwardly of the mold, whereby molten metal is continuously poured into the cooled mold to solidify the molten metal so that a cast piece quadrangular in cross section is continuously produced. Delay in solidification at sites near the corners of the cast piece is eliminated, and high quality, high speed casting is realized.

9 Claims, 5 Drawing Sheets

BILLET CONTINUOUS CASTING MACHINE

BACKGROUND OF THE INVENTION

This invention relates to a billet continuous casting machine and casting method which continuously pour molten metal into a tubular mold to solidify it, thereby continuously producing a cast piece of a regular square or rectangular cross sectional shape.

FIG. 7 is an explanation drawing showing an example of a conventional billet continuous casting machine.

As shown in the drawing, molten metal (molten steel) is poured through a molten metal nozzle 101 into a mold 100. At this time, cooling water is sprayed through a multiplicity of spray nozzles 102 arranged outside the mold 100 to cool the mold 100. While the molten metal inside the mold 100 is gradually moving downward, its peripheral area is solidified. A cast piece 103 is continuously formed and forced out of the mold 100.

The cooling water is supplied by a pump or the like (not shown) through a cooling water inlet 104 into a jacket 105. The water flowing in the jacket 105 cools the surroundings of the mold 100, or cools the mold 100 by its sprays through the spray nozzles 102 as mentioned above, and is then discharged through a cooling water outlet 106.

The mold 100 is in a tubular form with a regular square cross section, and is provided with a linear taper (inclination) ranging from a molten metal inlet at the top of the mold to a cast piece outlet at the bottom of the mold. Its taper value is 1% or less, and a generally used taper value is 0.6 to 0.8%.

As described above, a conventional billet continuous casting machine sets a taper in the mold 100, disposes cooling means for the mold, and performs an operation while suitably combining a cooling rate with the taper and the cooling means.

With the conventional billet continuous casting machine, the taper of the mold 100 was relatively small, and low speed casting posed few problems. High speed casting (3 m/min or more), however, caused the following insoluble problems: At the corners of a lower part of the mold 100, air gaps (gaps between the mold and a solid shell which are generated because of the nonuniform growth of the solid shell in the mold; gap generation is marked at the corners of the lower part of the mold) appear between the mold 100 and the cast piece 103. Furthermore, the site of delay in solidification occurs in the cast piece from its corners as far as 10 mm or so apart, thereby deteriorating the quality of the product markedly. That is, the occurrence of the air gaps makes the cooling of the cast piece 103 nonuniform, thus inducing deformation, cracks or structure defects of the cast piece 103. The occurrence of the site of solidification delay, moreover, causes rhombic deformation or breakout.

SUMMARY OF THE INVENTION

It is an object of the present invention, therefore, to provide a billet continuous casting machine and casting method capable of high quality, high speed casting.

To attain this object, the invention concerns a billet continuous casting machine comprising cooling means for cooling an outer wall of a tubular mold, electromagnetic brakes disposed outside the mold and decelerating the flow of molten metal poured into the mold, molten metal level detecting means for detecting and controlling the level of molten metal in the mold, notched portions formed at the corners of a quadrangular lower part of the mold, and cooling liquid spray means for spraying a cooling liquid directly onto the notched portions; and having elastically pushing means for imparting a pushing force corresponding to the static pressure of the molten metal to unnotched portions of the quadrangular lower part of the mold to push the unnotched portions inwardly of the mold; whereby molten metal is continuously poured into the cooled mold to solidify the molten metal so that a cast piece quadrangular in cross section is continuously produced.

Preferably, taper portions are provided in an upper part of the tubular mold.

Preferably, the tubular mold is curved in an arcuate form in the direction of drawing of the cast piece.

Preferably, the molten metal level detecting means is an X ray- or γ ray-based level sensor which comprises an emitting portion and a receiving portion disposed on a nearly diagonal line of the tubular mold and detects the molten metal level at a position unaffected by the flow of molten metal poured through the molten metal nozzle into the mold.

Preferably, controlling means is provided for controlling the speed of cast piece drawing by pinch rolls based on a molten metal level signal from the molten metal level detecting means.

A billet continuous casting method related to the invention comprises pouring molten metal into a water-cooled tubular mold having notched portions at the corners of a lower part of the mold; pulling out a dummy bar in the mold when a molten metal level signal from molten metal level detecting means has reached a predetermined value of the level in the mold; starting casting while applying electromagnetic brakes to the poured molten metal flow in the mold; decreasing the speed of cast piece drawing by pinch rolls when the molten metal level signal has fallen short of a predetermined value range of the level in the mold; and increasing the speed of cast piece drawing when the molten metal level signal has exceeded the predetermined value range of the level in the mold.

DETAILED DESCRIPTION OF THE PREFERRED EMBODIMENTS

A billet continuous casting machine and casting method related to the present invention will now be described in detail by way of Embodiments using the accompanying drawings.

[First Embodiment]

<Constitution>

Figure 1:
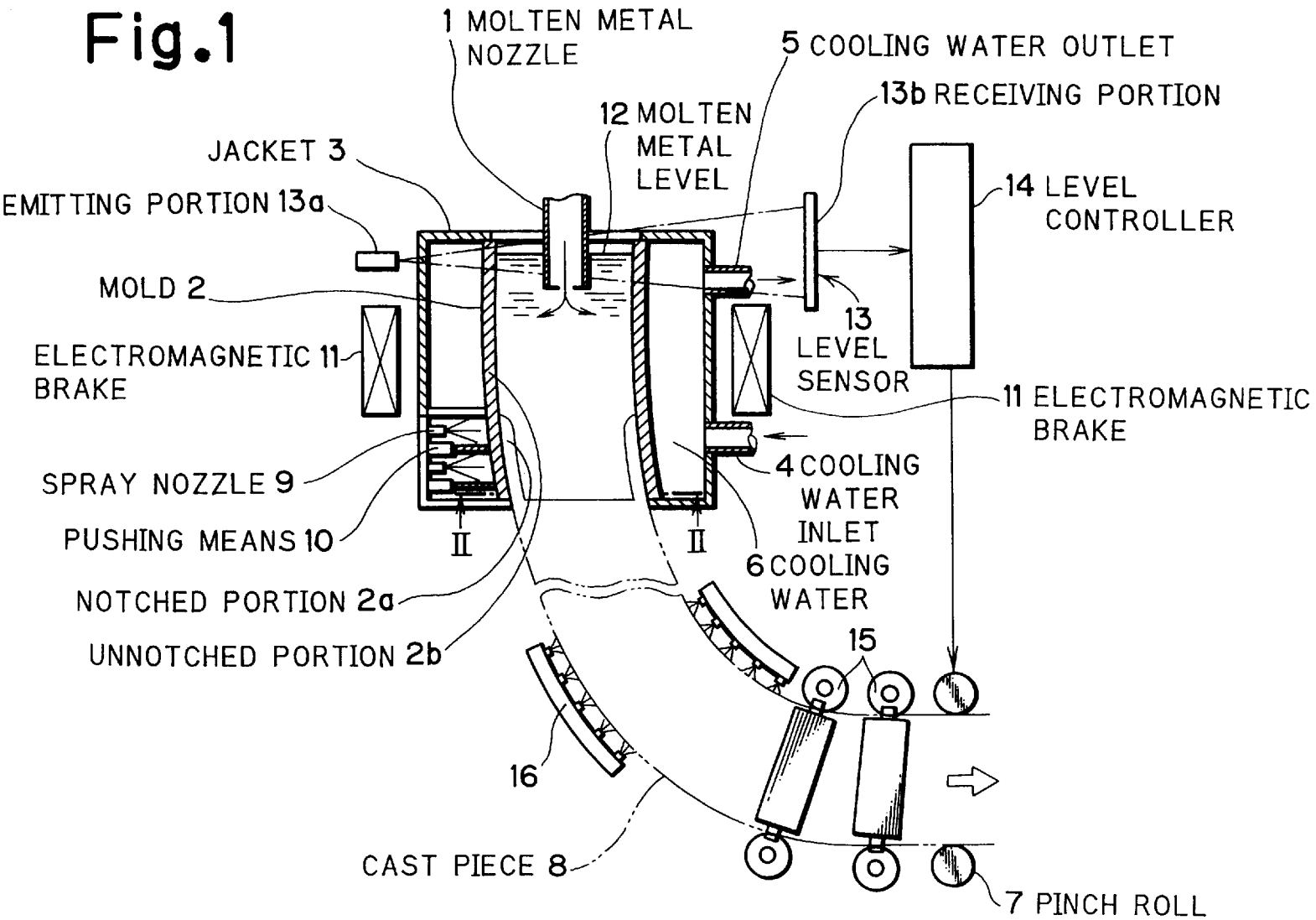
FIG. 1 is a sectional view of a billet continuous casting machine showing a first embodiment of the present invention.
Figure 2:
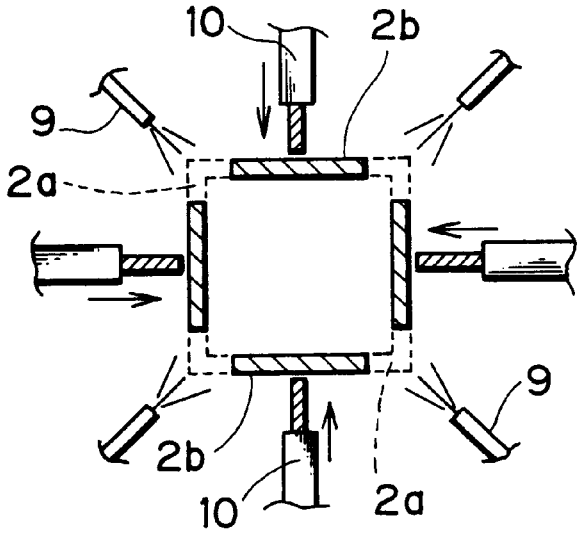
FIG. 2 is a view taken on line II—II of FIG. 1.
Figure 3:
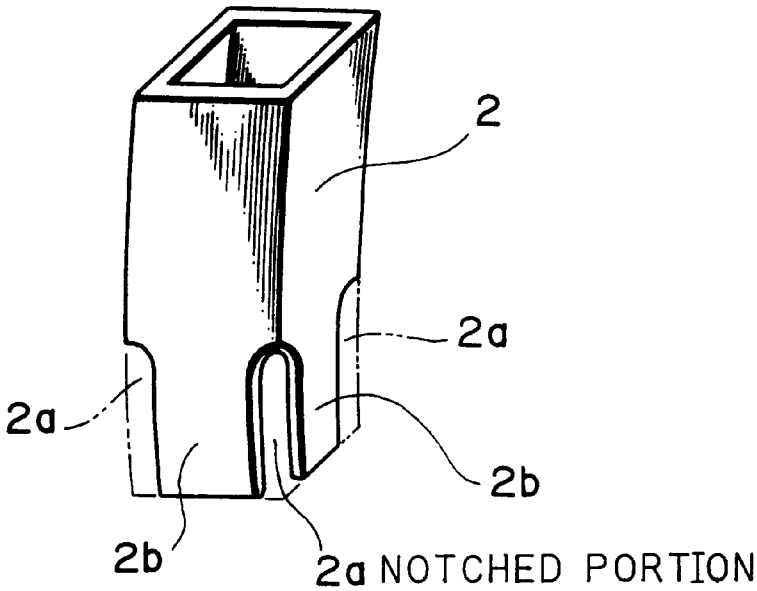
FIG. 3 is a perspective view of a mold of FIG. 1.
Figure 4:
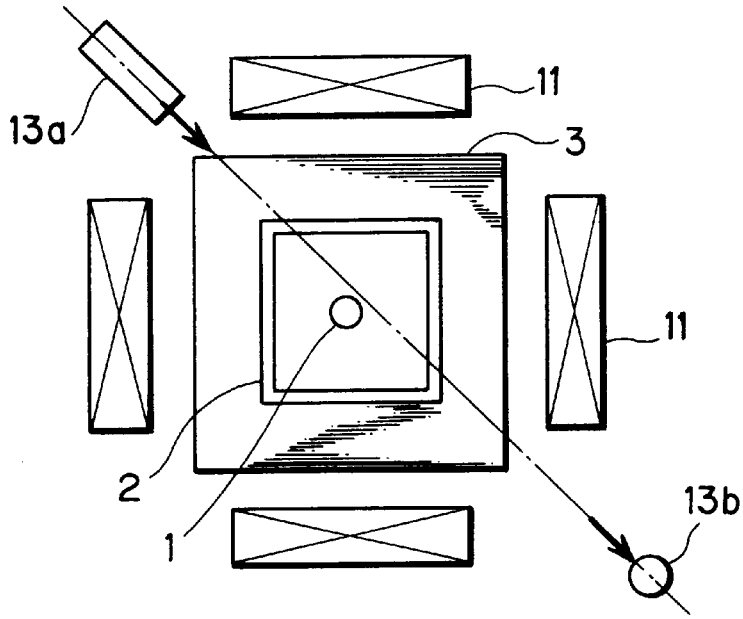
FIG. 4 is a plan view showing molten metal level detecting means of the invention.
Figure 5:
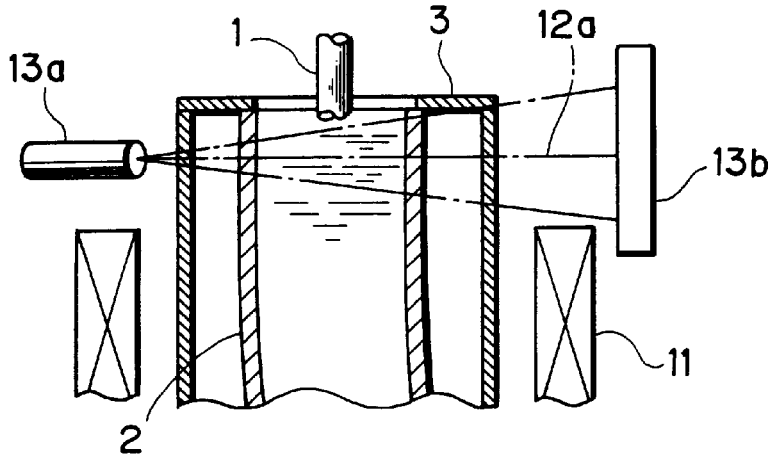
FIG. 5 is a partly sectional front view of the molten metal level detecting means of FIG. 4.

FIG. 1 is a sectional view of a billet continuous casting machine showing a first embodiment of the present invention. FIG. 2 is a view taken along line II—II of FIG. 1. FIG. 3 is a perspective view of a mold of FIG. 1. FIG. 4 is a plan view showing molten metal level detecting means. FIG. 5 is a partly sectional front view of the molten metal level detecting means of FIG. 4.

As shown in FIG. 1, molten metal, such as molten steel, is continuously poured into a mold 2 through a molten metal nozzle 1. The mold 2 is disposed in a jacket 3 constituting cooling means, and is cooled with cooling water 6 supplied into the jacket 3 and circulated there through a cooling water inlet 4 and a cooling water outlet 5.

The mold 2 is formed in the shape of a tube curved arcuately in the direction of drawing of a cast piece 8 by pinch rolls 7 and having a quadrangular (regular square or rectangular) cross section. At the four corners of a quadrangular lower part of the mold 2, notched portions 2*a* having predetermined lengthwise and widthwise dimensions are formed as shown in FIG. 3.

As illustrated in FIG. 2, spray nozzles (cooling liquid spray means) 9 are disposed for directly spraying cooling water onto the molten metal in the mold 2 opposite the respective notched portions 2*a*. Pushing means 10 are also provided for pushing unnotched portions 2*b* of the quadrangular lower part of the mold 2 inwardly of the mold 2 at a pushing force corresponding to the static pressure of the molten metal.

The pushing means 10 are each constituted such that a push rod or the like is urged by a spring, air cylinder or the like. If the cast piece 8 swells abnormally, the pushing means 10 allow the escape of the unnotched portions 2*b* to enable the drawing of the cast piece 8.

Outside the jacket 3, electromagnetic brakes 11 are disposed for decelerating the flow of the poured molten metal in the mold 2, and an X ray (or γ ray)-based level sensor (molten metal level detecting means) 13 is disposed for detecting the level of molten metal (meniscus) 12 in the mold 2.

The electromagnetic brakes 11 decelerate the flow of the poured molten metal by a magnetic field acting on the poured molten metal perpendicularly. As shown in FIG. 4, the electromagnetic brakes 11 are disposed at four sites on the outer periphery of the jacket 3.

The level sensor 13 detects the position of the molten metal level in such a manner that its emitting portion 13*a* emits X rays (or γ rays) toward the level 12 of molten metal in the mold 2 and its receiving portion 13*b* receives a level image of the molten metal level 12. As shown in FIG. 4, the emitting portion 13*a* and the receiving portion 13*b* are placed with the use of a space where the electromagnetic brakes 11 are not disposed, namely, on a nearly diagonal line of the jacket 3 (mold 2). Furthermore, the level sensor 13 detects the molten metal level 12 at a position unaffected by the flow of molten metal from the molten metal nozzle 1 into the mold 2 (i.e., the position of the molten metal level; at this position, the site where molten metal is present and the site where molten metal is absent are sensed, whereby the right position of the molten metal level can be measured). The emitting portion 13*a* and the receiving portion 13*b* are disposed at positions at which they can detect the range of changes in the molten metal level with a reference surface 12*a* falling in the range, and at which they do not undergo interference by the electromagnetic brakes 11, as shown in FIG. 5.

A signal on the molten metal level detected by the receiving portion 13*b* is entered in a level controller (controlling means) 14. The level controller 14 variably controls the speed of cast piece drawing by the pinch rolls 7 based on the molten metal level signal. Thus, the level controller 14 performs feedback control so that the molten metal level 12 always takes a value within a predetermined value range of the level.

That is, the level controller 14 decreases the speed of cast piece drawing by the pinch rolls 7 when the molten metal level signal has fallen short of a predetermined value range of the level in the mold, and increases the speed of cast piece drawing when the molten metal level signal has exceeded the predetermined value range of the level in the mold 2. Thus, the level controller 14 always maintains the molten metal level 12 in the predetermined value range of the level.

In FIG. 1, the numeral 15 denotes a guide roller for feeding the cast piece 8 discharged from the cast piece outlet of the mold 2 to the pinch rolls 7 while arcuately guiding it. The numeral 16 denotes a cooling water spray. The electromagnetic brakes 11 and the level sensor 13 preferably have cooling water flow equipment for self-cooling. Into the aforementioned cast piece outlet, a dummy bar (not shown) is inserted for serving as a molten metal stopper before the start of casting and a guide for cast piece drawing.

<Actions●Effects>

The foregoing billet continuous casting machine is generally operated in the following manner:

① Preparations for the start of casting are finished (insertion of the dummy bar into the mold 2, setting of cooling materials, flow of cooling water into the jacket 3 and the spray nozzle 9, etc.).

② The level sensor 13 is turned on.

③ Molten metal is poured into the mold 2 through the molten metal nozzle 1.

④ After the reference molten metal level 12*a* is detected by the level sensor 13, the dummy bar is pulled out, and vibrations of the mold 2 are started.

⑤ At a time when the dummy bar leaves the mold 2, the electromagnetic brakes 11 are energized.

⑥ The respective devices are operated at their set values, and the cast piece 8 is continuously produced.

Upon completion of casting, the following procedure is performed:

① The pouring of molten metal is stopped.

② Energization of the electro magnetic brakes 11 is terminated.

③ The level sensor 13 is turned off.

④ After the cast piece 8 goes out of the mold 2, the vibrations of the mold 2, and the flow of cooling water into the jacket 3 and spray nozzles 9 is stopped.

According to the billet continuous casting machine of the instant embodiment, when molten metal is continuously poured into the mold 2, the flow of the poured molten metal in the mold 2 is decelerated by the electromagnetic brakes 11. This results in a uniformly thick solidified film of the cast piece 8 on its entire peripheral surface in contact with the mold. Thus, the quality of the cast piece 8 particularly under high speed casting improves. If there are none of the electromagnetic brakes 11, the initial thickness of the solidified film is small locally. As solidification proceeds, a bend or the like of the cast piece 8 occurs, making it impossible to keep the quality of the cast piece 8 constant. The output of the electromagnetic brakes 11 is constant with a central magnetic flux density of 0.2 T (tesla) or more and a frequency of 2.5 hertz or less. These set values are suitably varied according to the shape of the mold.

In the instant embodiment, moreover, cooling water is sprayed by the spray nozzle 9 onto the notched portions 2*a* formed at the corners of the mold lower part to directly cool the corners of the cast piece 8. As a result, the cooling of the corners of the cast piece 8 is quickened, and the growth of a solid shell at the corners is promoted. Thus, the delay in solidification at sites near the corners of the case piece during high speed casting is eliminated.

In addition, the unnotched portions 2*b* of the mold lower part are pushed by the pushing means 10 inwardly of the mold 2 at a pushing force comparable to the static pressure of the molten metal. Consequently, the expansion of the cast piece and the occurrence of air gaps are prevented, and the quality of the cast piece 8 is improved.

The level 12 of molten metal in the mold 2 changes with the casting speed of the cast piece 8 (the speed of cast piece drawing by the pinch rolls 7). The amount of this change is detected by the X ray (or γ ray)-based level sensor 13. That is, when X ray (or γ ray) is emitted by the emitting portion 13*a* toward the molten metal level 12 in the mold 2, a level image of the molten metal level 12 is received by the receiving portion 13*b* to detect the position of the molten metal level. The resulting detection signal is fed back by the level controller 14 to the casting speed of the cast piece 8 as stated earlier.

As a result, the molten metal level in the mold 2 is always kept in the predetermined value range of the level. Thus, the cooling action for the molten metal via the mold 2 is properly performed, and high speed, high quality cast piece production can be performed continuously stably.

Also, the level sensor 13 for detecting the molten metal level 12 is disposed at a position lying on a nearly diagonal line of the mold 2 and unaffected by the flow of the poured molten metal. Thus, the molten metal level 12 can be detected properly. Furthermore, the X ray (or γ ray)-based level sensor 13 is used, so that the time delay of detection is small, meaning a quick response.

In the instant embodiment, the mold 2 is curved in an arcuate form in the direction of drawing of the cast piece 8 by the pinch rolls 7. Thus, the cast piece 8 can be drawn downward in a curved condition from the beginning. Hence, stress when curving the cast piece 8 by means of the guide roller 15 can be decreased, and the height of the continuous casting machine itself can be reduced.

In this manner, while the molten metal in the mold 2 is gradually moving downward, its peripheral part is solidified to form a solid shell having a uniform thickness. The resulting cast piece 8 is continuously withdrawn from the cast piece outlet.

<Experimental Example>

Experimental Example is given below.

Mold (2): Made of copper (150 mm square×1,100 mm in length)

Notched portion (2*a*):

300 mm from the bottom of the corner of the mold×30 mm in width)

Amount of water from spray nozzle (9):

150 liters/min

Casting speed: 5 m/min

Mold vibrations:

300 cycles/min, amplitude±3 mm

Level gauge: X ray-based level sensor (12)

Electromagnetic brake (11):

Magnetic flux density 2,000 gausses, frequency 1 Hz, two-phase (phase difference 90°) energization Cast piece (8): Carbon steel (0.2%C)

Experiments conducted under these conditions demonstrated that continuous casting could be performed stably at a higher casting speed of 5 m/min than a conventional casting speed (3 m/min). Thus, high speed casting became possible without any harmful defects, such as cracks, in a cast piece 8 taken out of the mold 2.

<Second Embodiment>

Figure 6:
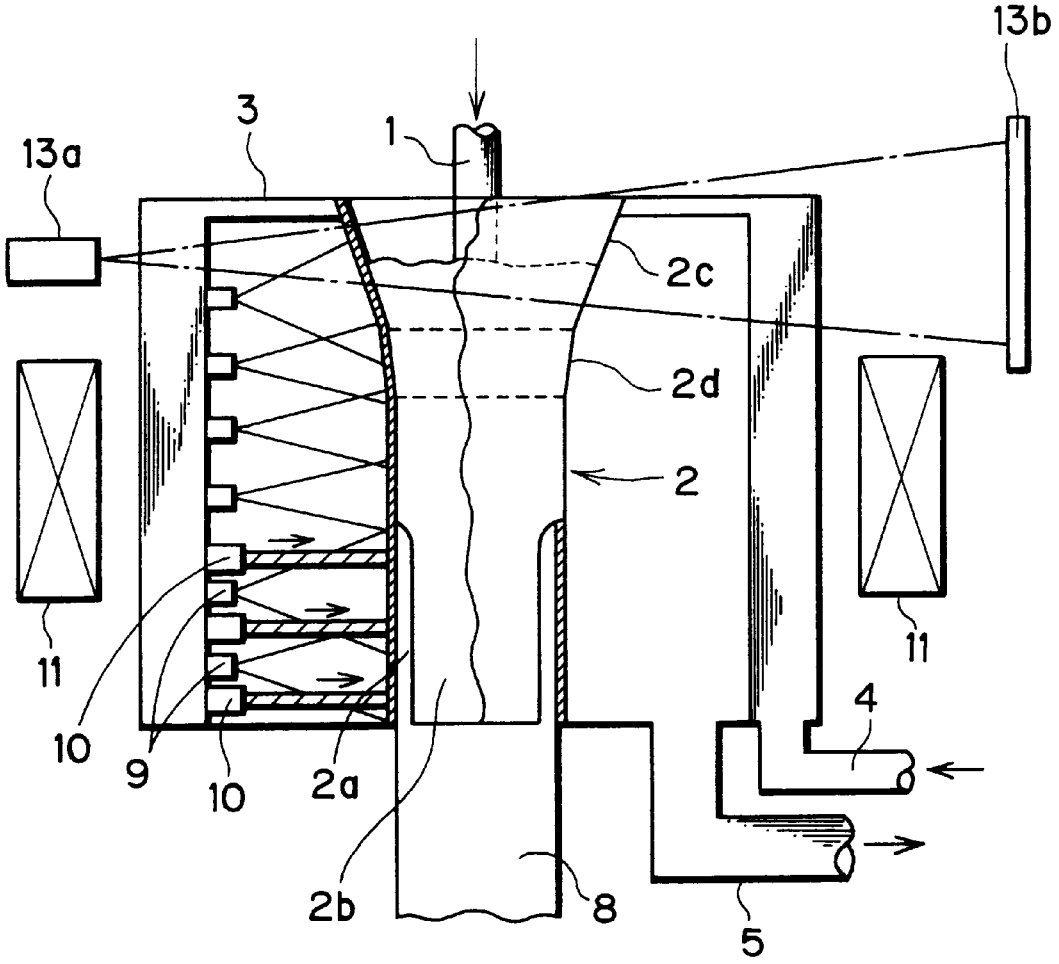
FIG. 6 is a sectional view of an essential part of a billet continuous casting machine showing a second embodiment of the invention.
Figure 7:
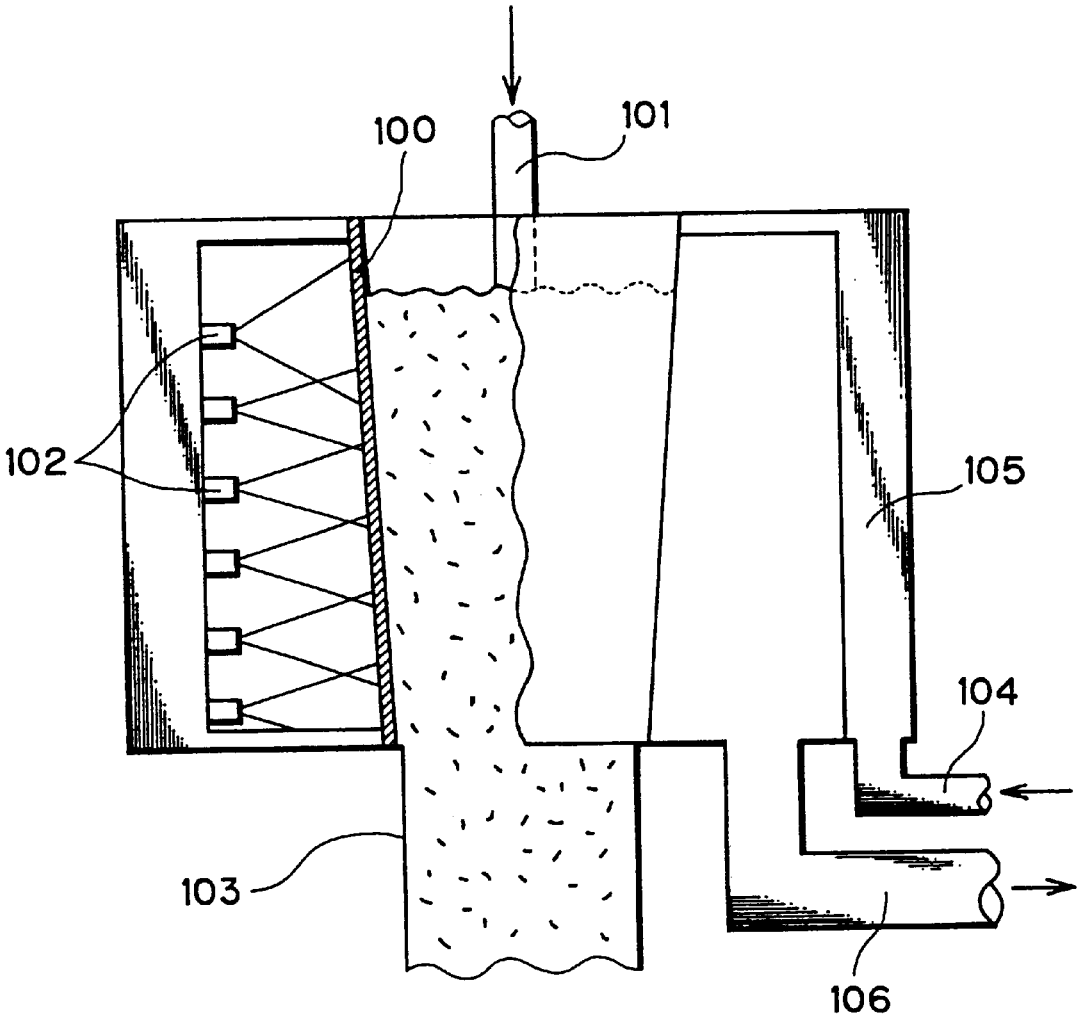
Fig.7 PRIOR ART
FIG. 7 is an explanation drawing showing a conventional billet continuous casting machine.

FIG. 6 is a sectional view of a billet continuous casting machine showing a second embodiment of the present invention.

This is an embodiment in which the spray nozzles 9 in the first embodiment were used for cooling the entire mold 2, and two taper portions 2*c*, 2*d* with different taper values were provided in an upper part of the mold 2. The other constitutions are the same as in the first embodiment.

According to this embodiment, the taper values of the two taper portions 2*c*, 2*d* are agreed with the solidifying speed of molten metal, and the taper value of the lower taper portion 2*d* is always smaller than that of the upper taper portion 2*c*. Thus, molten metal moves smoothly to the downward cast piece outlet, and the amount of air gaps between the mold 2 and the cast piece 8 decreases. This brings the advantage that the cooling rate of the cast piece 8 can be made uniform. Other actions and effects are the same as in the first embodiment.

It goes without saying that the present invention is not restricted to the above-described embodiments, and various changes and modifications, such as the morphological change of the mold and the change of the cooling means, may be made without departing from the gist of the invention.

To sum up, the invention comprises cooling means for cooling an outer wall of a tubular mold, electromagnetic brakes disposed outside the mold and decelerating the flow of poured molten metal in the mold, molten metal level detecting means for detecting and controlling the level of molten metal in the mold, notched portions formed at the corners of a quadrangular lower part of the mold, and cooling liquid spray means for spraying a cooling liquid directly onto the notched portions; and having elastically pushing means for imparting a pushing force corresponding to the static pressure of the molten metal to unnotched portions of the quadrangular lower part of the mold to push the unnotched portions inwardly of the mold; whereby molten metal is continuously poured into the cooled mold to solidify the molten metal so that a cast piece quadrangular in cross section is continuously produced. Thus, the following advantages are obtained:

① The flow of molten metal poured through the molten metal nozzle speeds up according to high speed casting. This flow is decelerated by the electromagnetic brakes, and deformation of the cast piece associated with fluctuations in the molten metal level and remelting of the cast piece is prevented.

② At the corners of the cast piece, gaps are formed between the cast piece and the mold because of the solidification and shrinkage of the cast piece. As a result, insufficient cooling results, the cast piece thins, and breakout or deformation is apt to occur especially during high speed casting. These disadvantages can be prevented by notching the mold, and cooling the corners of the cast piece with sprayed water at an early stage.

③ The corners of the lower part of the mold are notched to bring the unnotched portions of the mold into constant contact with the cast piece. By this measure, the thickness of the cast piece that tends to decrease during high speed casting can be increased.

Thus, a billet continuous casting machine capable of high quality, high speed casting can be realized.

Furthermore, taper portions are provided in an upper part of the tubular mold. Thus, molten metal is moved smoothly to the downward cast piece outlet according to the solidification speed, and the amount of air gaps between the mold and the cast piece decreases. Consequently, the cooling rate of the cast piece can be made uniform.

Furthermore, the tubular mold is curved in an arcuate form in the direction of drawing of the cast piece. Thus, the cast piece can be drawn downward in a curved condition from the beginning. Hence, stress when curving the cast piece by means of the guide roller can be decreased, and the height of the continuous casting machine itself can be reduced.

Furthermore, the molten metal level detecting means is the X ray- or γ ray-based level sensor which comprises the emitting portion and the receiving portion disposed on a nearly diagonal line of the tubular mold and which detects the molten metal level at a position unaffected by the flow of molten metal poured from the molten metal nozzle into the mold. Thus, its response to fluctuations in the molten metal level is quick, permitting molten metal level control with a delay in response which is about a tenth of that of conventional means. Higher speed casting than before is possible.

Furthermore, the controlling means is provided for controlling the speed of cast piece drawing by pinch rolls based on a molten metal level signal from the molten metal level detecting means. Thus, the molten metal level in the mold is always kept within a predetermined value range of the level in the mold. Also, the cooling action for the molten metal via the mold 2 is properly performed. Hence, high quality, high speed cast piece production can be performed continuously in a stabilized manner.

The billet continuous casting method related to the invention comprises pouring molten metal into a water-cooled tubular mold having notched portions at the corners of a lower part of the mold; pulling out a dummy bar in the mold when a molten metal level signal from molten metal level detecting means has reached a predetermined value of the level in the mold; starting casting while applying electromagnetic brakes to the poured molten metal flow in the mold; decreasing the speed of cast piece drawing by pinch rolls when the molten metal level signal has fallen short of a predetermined value range of the level in the mold; and increasing the speed of cast piece drawing when the molten metal level signal has exceeded the predetermined value range of the level in the mold. Thus, the molten metal level in the mold is always kept within the predetermined value range of the level. Also, the cooling action for the molten metal via the mold is properly performed. Hence, high quality, high speed cast piece production can be performed continuously in a stabilized manner.

What is claimed is:

1. A billet continuous casting machine, comprising:

a tubular mold adapted to receive molten metal;

a molten metal nozzle adapted to pour the molten metal into said tubular mold;

a cooling unit adapted to cool an outer wall of said tubular mold;

electromagnetic brakes disposed outside said mold and decelerating the flow of the molten metal poured into said mold;

a molten metal level detecting unit adapted to detect and control the level of the molten metal in said mold;

notched portions formed at the corners of a quadrangular lower part of said mold;

a cooling liquid spray unit adapted to spray a cooling liquid directly onto said notched portions; and an elastically pushing unit adapted to impart a pushing force corresponding to the static pressure of the molten metal to said unnotched portions in an inward direction of the quadrangular lower part of the mold to push the unnotched portions of the mold, whereby the molten metal is continuously poured into the cooled mold to solidify the molten metal so that a cast piece quadrangular in cross section is continuously produced.

2. The billet continuous casting machine of claim 1, wherein taper portions are provided in an upper part of said tubular mold.

3. The billet continuous casting machine of claim 2, wherein said taper portions include an upper taper portion having a first taper value and a lower taper portion having a second taper value smaller than said first taper value.

4. The billet continuous casting machine of claim 1 or 2, wherein said tubular mold is curved in an arcuate form in the direction of drawing of the cast piece.

5. The billet continuous casting machine of claim 4, wherein said molten metal level detecting unit is one of ar X ray-based and γ ray-based level sensor including an emitting portion and a receiving portion disposed along a nearly diagonal line of said tubular mold, and being adapted to detect the molten level at a position unaffected by the flow of the molten metal poured through said molten metal nozzle into said mold.

6. The billet continuous casting machine of claim 4, further comprising:

a controlling unit adapted to control the speed of cast piece drawing by pinch rolls based on a molten metal level signal from said molten metal level detecting unit.

7. The billet continuous casting machine of claim 1 or 2, wherein said molten metal level detecting unit is one of an X ray-based and γ ray-based level sensor including an emitting portion and a receiving portion disposed along a nearly diagonal line of said tubular mold, and being adapted to detect the molten metal level at a position unaffected by the flow of the molten metal poured through said molten metal nozzle into said mold.

8. The billet continuous casting machine of claim 7, further comprising:

a controlling unit adapted to control the speed of cast piece drawing by pinch rolls based on a molten metal level signal from said molten metal level detecting unit.

9. The billet continuous casting machine of claim 1 or 2, further comprising:

a controlling unit adapted to control the speed of cast piece drawing by pinch rolls based on a molten metal level signal from said molten metal level detecting unit.

* * * * *